US005258963A

United States Patent [19]

Yao

[11] Patent Number: 5,258,963

[45] Date of Patent: Nov. 2, 1993

[54] AUTOMATIC ROCKING DEVICE

[76] Inventor: Ching-Hui Yao, P.O. Box 10780, Taipei, Taiwan

[21] Appl. No.: 26,876

[22] Filed: Mar. 4, 1993

[51] Int. Cl.[5] ..... G04B 47/00; G04B 19/00; G04B 37/00

[52] U.S. Cl. ..... 368/10; 368/272; 368/276; 368/316

[58] Field of Search ..... 368/10, 88, 134, 165, 368/179, 272-273, 276, 316, 317

[56] References Cited

U.S. PATENT DOCUMENTS 3,845,617 11/1974 Holzmann ..... 368/134
4,241,437 12/1980 Ashida ..... 368/134
4,421,421 12/1983 Bradt ..... 368/229
4,509,865 4/1985 Chu ..... 368/134
4,613,236 9/1986 Nakamura ..... 368/165
4,707,144 11/1987 Mukoyama ..... 368/165

*Primary Examiner*—Vit W. Miska

[57] ABSTRACT

An automatic rocking device including a container with a curved base and having accommodated therein a timepiece, a power supply device, a delay circuit and an automatic rocking mechanism. When the motor gets power supply, it drives the mechanism to reciprocate along the axis of gravity of the container to cause the container to lose equilibrium and rock.

5 Claims, 3 Drawing Sheets

AUTOMATIC ROCKING DEVICE

FIELD OF THE INVENTION

The present invention relates generally to an automatic rocking device, and particularly to an ornament that automatically rocks without the help of outside forces.

BACKGROUND OF THE INVENTION

Conventional articles for display on the table, such as clocks, toys, ornaments and the like, and which can produce motion are restricted to certain parts of the article, such as the hands or the pendulum of clocks. Ornamental movement is therefore not obvious.

The present invention aims to improve such deficiency in conventional articles, and especially table clocks.

Conventional clocks or time-pieces have various designs; they may be wall clocks or table clocks. Table clocks are usually displayed in a static manner, or some are provided with a pendulum, but the space of movement is limited, and the act of movement is also monotonous.

Those in the field have endeavored to improve these limitations, but until now, there is still not new structure or device available to provide a breakthrough in conventional design.

SUMMARY OF THE INVENTION

The primary object of the present invention is to provide an ornamental device which enables an article such as the clock to perform an automatic rocking motion without the help of external forces.

According to the present invention, the base of an ornamental article, or at least a part of the base, is caused to form a curved structure. The axis of gravity of the article is approximately around the central part of the curved structure. The inside of the article accommodates a power supply device, an automatic rocking mechanism, and a delay circuit, wherein the power supply device may timely supply power to the motor of the rocking mechanism and to the delay circuit. When a timepiece or any suitable switch device causes the power supply device to supply power to the motor, the motor rotates and drives an eccentric rod to turn so that the eccentric rod pushes the automatic rocking mechanism to reciprocate along a track substantially perpendicular to the axis of gravity of the article so that the container loses equilibrium and rocks.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
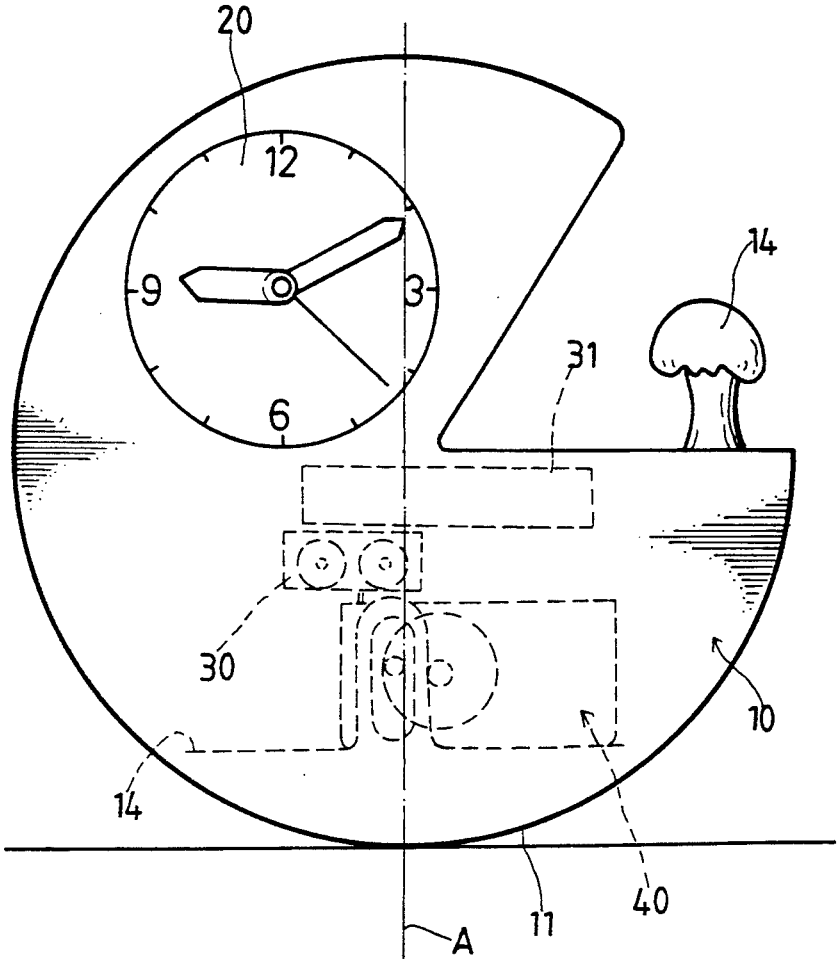
FIG. 1 is an elevational view of a preferred embodiment of the present invention.

As shown in the drawings, the table clock is used as a preferred embodiment of the present invention. But as is well known, the same device may also be applied to other designs of clocks, toys, or articles having similar features.

The present invention comprises a container 10 with an axis of gravity A. A timepiece 20, such as the pointer-type clock, is fixed on the container 10. The timepiece 20 has its own power supply source. A power supply device 30, such as battery, is also fixed inside the container 10. The power supply device 30 is connected to a delay circuit device 31 fixed inside the container 10 and to a motor 42 (to be described hereinafter).

The container 10 has a curved base 11; adjacent to the inside of the base 11 is a guide plate 13 provided with a vertical slot 12. The inside of the container 10 has an automatic rocking mechanism 40 which can move left-and-right along the horizontal track 14. The track 14 is substantially perpendicular to the axis of gravity A, and the vertical slot 12 of the guide plate 13 is higher than the height of the track 14. The axis of gravity A remains at approximately the center of the curved base 11.

The automatic rocking mechanism 40 includes a gear box 41. The gear box 41 contains the motor 42 which drives a deceleration gear set 43. The output shaft of the deceleration gear set 43 has fixed thereon a wheel 44 which is provided with an eccentric rod 441. The eccentric rod 441 just fits into the vertical slot 12 of the guide plate 13. It is obvious that the distance between the highest point and the lowest point of the vertical slot 12 exceeds the distance between the highest point and the lowest point of the eccentric rod 441. Also, the motor 42 of the automatic rocking mechanism 40 is connected to and controlled by the above mentioned delay circuit device 31.

Figure 2:
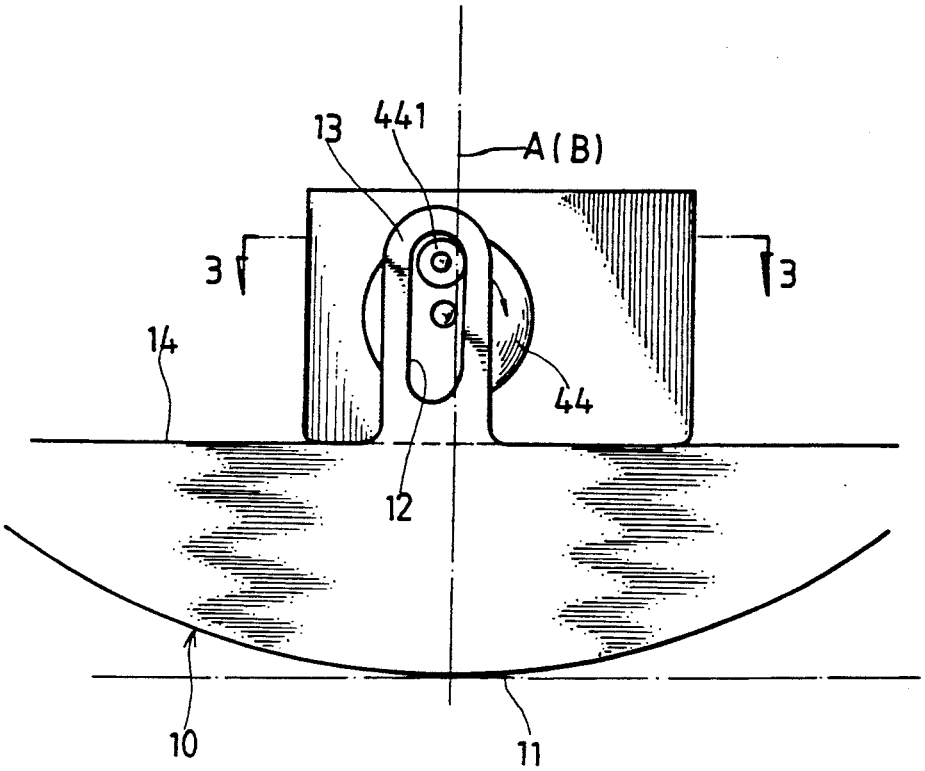
FIG. 2 is a partially enlarged sectional view of FIG. 1.
Figure 3:
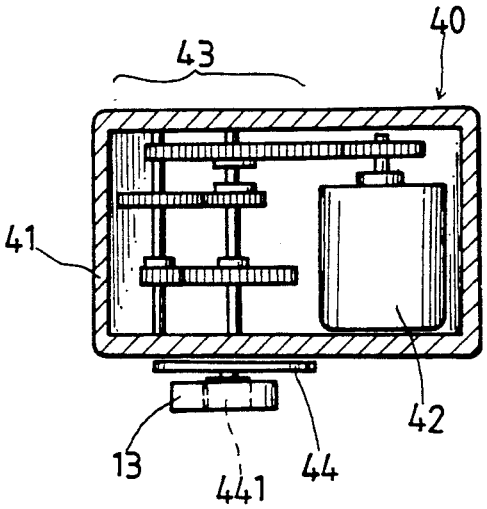
FIG. 3 is a sectional view taken along line 3—3 of FIG. 2.
Figure 4:
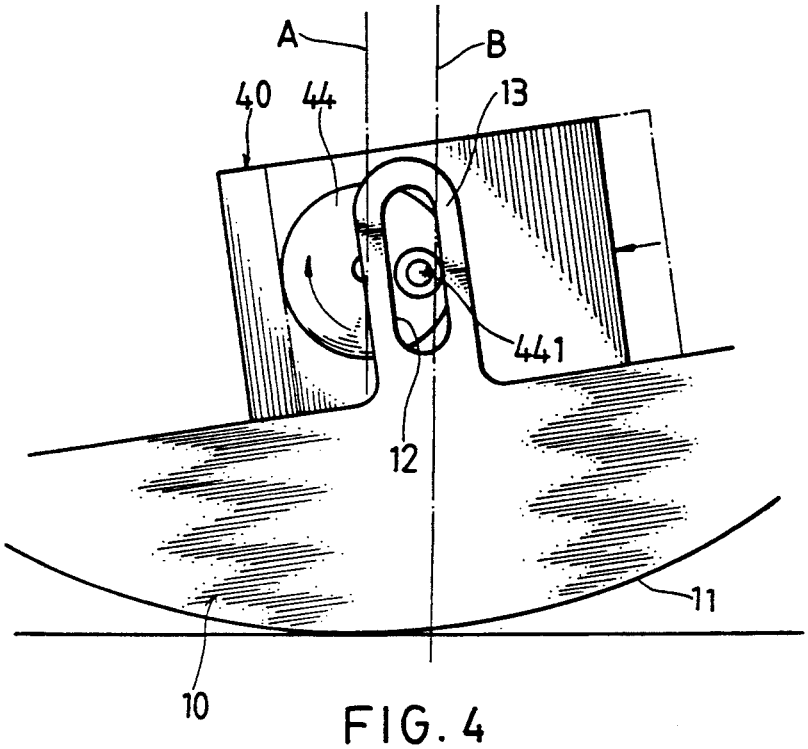
FIG. 4 is similar to FIG. 2, but showing the act of rocking to the left.
Figure 5:
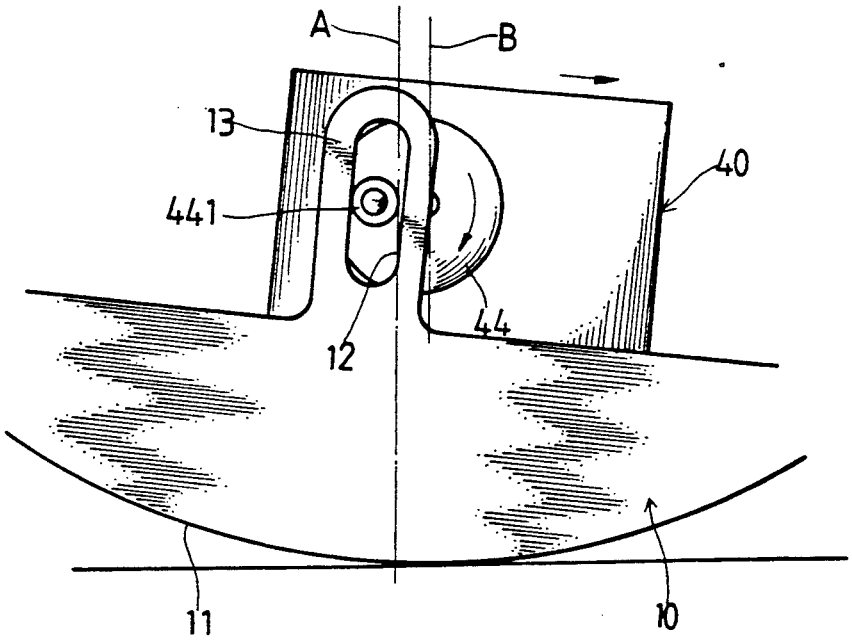
FIG. 5 is similar to FIG. 2, but showing the act of rocking to the right.

As shown in FIGS. 4 and 5, the automatic rocking mechanism 40 of the present invention includes a constant axis of gravity B which, under normal circumstances, almost overlaps with the axis of gravity A of the container 10, as shown in FIG. 2.

When the timepiece 20 outputs a signal to the delay circuit device 31, the motor 42 of the automatic rocking mechanism 40 simultaneously obtains power supply from the power supply device 30 and starts turning, so that the wheel 44 brings the eccentric rod 441 to rotate with it. When the eccentric rod 441 turns to the right, the counter force will push the gear box 41 to move to the left, causing the axis of gravity B of the gear box 41 moves left to the left side of the axis of gravity A of the container 10, the container 10 therefore inclines to the left. Likewise, when the eccentric rod 441 moves to the left, as shown in FIG. 5, the gear box is caused to move to the right so that the axis of gravity B moves to the right side of the axis of gravity A and the container 10 inclines to the right. Thereby, the container 10 loses equilibrium, and because the base of the container 10 is curved, the entire container 10 is caused to rock, until the delay circuit device 31 cuts off power supply to the motor 42.

A speaker device may also be provided in the above-mentioned container 10 to form an alarm clock or music alarm clock. At the preset time, the speaker device produces music and simultaneously the automatic rocking mechanism 40 gradually reciprocates so that the the container 10 rocks.

Furthermore, as shown in FIG. 1, the container 10 may also be provided with a magnet to attract thereon a small ornament 14. This not only adds beauty to the overall article but also helps adjust the left and right position of the container 10. This also helps in the alignment of the two axes of gravity A, B.

In view of the aforesaid, the present invention is a novel device by which articles having a curved base may have the ornamental effect of rocking at a preset time. Whether the device is used in clocks, toys, or other articles, whether they are time-measuring devices, they are able to perform rocking motion without the help of outside forces. If there are no time-measuring devices, the device for sending signals to the delay circuit may be controlled by manually operated switches, sound control, or light control, etc. These substitute methods are well known to those skilled in the art and are not described in detail herein.

Although the present invention has been illustrated and described with reference to the preferred embodiments thereof, it should be understood that it is in no way limited to the details of such embodiments, but is capable of numerous modifications within the scope of the appended claims.

What is claimed is:

1. An automatic rocking device, comprising a container with a base and having an axis of gravity;

a power supply device fixed inside said container;

an automatic rocking mechanism, capable of being movably accommodated within said container, said mechanism having a gear box to accommodate a motor and a deceleration gear set driven by said motor, said deceleration gear set having an output shaft, and said motor being connected to said power supply device, and a delay circuit device connected to said power supply device and said motor, wherein said base of said container is a curved structure, and a guide plate having a vertical slot is disposed in said container;

said output shaft of said automatic rocking mechanism has fixed thereon an eccentric rod the end of which fits in said vertical slot of said guide plate;

said container has disposed therein a horizontal track substantially perpendicular to said axis of gravity, and said gear box of automatic rocking mechanism is capable of reciprocating along said track, and when said automatic rocking mechanism is pushed by said eccentric rod to reciprocate horizontally, its center of gravity moves left and right of said axis of gravity of said container so that said container loses equilibrium and rocks.

2. An automatic rocking device as claimed in claim 1, wherein said container has fixed therein a timepiece which is connected to said delay circuit device and said power supply device.

3. An automatic rocking device as claimed in claim 2, wherein said delay circuit device starts counting when said timepiece activates a signal at a preset time, and said signal causes said motor of said automatic rocking mechanism to rotate until said delay circuit device stops counting and said power supply device cuts off power supply to said motor.

4. An automatic rocking device as claimed in claim 2, wherein said timepiece is a music alarm clock.

5. An automatic rocking device as claimed in claim 4, wherein when said motor of said automatic rocking mechanism rotates, said timepiece simultaneously produces music sound.

* * * * *